US005180599A

United States Patent [19]

Feldmeier et al.

[11] Patent Number: 5,180,599

[45] Date of Patent: Jan. 19, 1993

[54] PEELABLE ADHESIVE-BASED PACKAGE SEAL AND METHOD OF MAKING SAME

[75] Inventors: Daniel R. Feldmeier, Waunakee; Michael McCann, Madison, both of Wis.

[73] Assignee: Oscar Mayer Foods Corporation, Madison, Wis.

[21] Appl. No.: 666,753

[22] Filed: Mar. 8, 1991

[51] Int. Cl.[5] ..... B65D 85/00

[52] U.S. Cl. ..... 426/106; 156/247; 156/272.6; 206/469; 206/470; 220/359; 229/125.35; 426/129; 428/40

[58] Field of Search ..... 426/106, 126, 127, 129; 206/631, 633, 469, 470; 220/359; 229/272.6, 344, 247; 428/40, 41, 42

[56] References Cited

U.S. PATENT DOCUMENTS

| | | | |
|---|---|---|---|
| 2,859,480 | 11/1958 | Berthold et al. . | |
| 3,081,214 | 3/1963 | Strome | 156/272 |
| 4,008,352 | 2/1977 | Dawes et al. | 428/474 |
| 4,183,434 | 1/1980 | Watt | 206/438 |
| 4,264,392 | 4/1981 | Watt | 206/631 |
| 4,284,703 | 8/1981 | Inoue | 430/142 |
| 4,365,716 | 12/1982 | Watt | 156/344 |
| 4,367,312 | 1/1983 | Bontinck et al. | 525/93 |
| 4,382,513 | 5/1983 | Schirmer | 426/127 |
| 4,484,574 | 11/1984 | DeRusha et al. | 128/156 |
| 4,656,068 | 4/1987 | Raines | 206/631 |
| 4,782,647 | 11/1988 | Williams et al. | 53/454 |
| 4,840,270 | 6/1989 | Caputo et al. | 206/205 |
| 4,847,148 | 7/1989 | Schirmer | 428/332 |
| 4,866,911 | 9/1989 | Grinrod et al. | 426/129 |
| 4,876,139 | 10/1989 | Yamamoto et al. | 428/200 |
| 4,888,223 | 12/1989 | Sugimoto et al. | 426/129 |

FOREIGN PATENT DOCUMENTS

| | | | |
|---|---|---|---|
| 59-157164 | 9/1984 | Japan | 428/40 |
| 61-186568 | 8/1986 | Japan | 428/40 |
| 61-290086 | 12/1986 | Japan | 428/41 |
| 1308770 | 12/1989 | Japan | 206/633 |

*Primary Examiner*—Steven Weinstein
*Assistant Examiner*—Jean L. Aberle
*Attorney, Agent, or Firm*—Lockwood, Alex, FitzGibbon & Cummings

[57] ABSTRACT

A process for forming an adhesive-based peelable, hermetic seal for a package in which the adhesive ruptures uniformly when the package is opened. A first polyacrylonitrile packaging film has a surface thereof treated with a corona discharge. An adhesive is applied to either the treated film or an opposing second packaging film and the first and second films are brought into contact. The corona discharge treatment of the polyacrylonitrile film reduces the bond strength between the adhesive and the treated film such that the adhesive peels cleanly and uniformly away from the seal area of the treated film, without "stringing".

26 Claims, 2 Drawing Sheets

PEELABLE ADHESIVE-BASED PACKAGE SEAL AND METHOD OF MAKING SAME

BACKGROUND AND SUMMARY OF THE PRESENT INVENTION

This invention relates primarily to adhesive-based package seals and secondarily to a method of manufacturing such seals. More particularly, the present invention relates to decreasing the adhesive bond strength of adhesive-based peelable package seals to enable the adhesive to peel uniformly away from one package surface.

Contemporary food product component packages have a variety of different package seals which seal the food product component in one way or another in the package. Some package seals are recloseable and allow repeated access to the package contents without affecting the integrity of the package. Other seals are tamper-evident which indicate whether package has been opened prior to purchase of the package. Yet other seals are hermetic and provide an air-tight and liquid-tight barrier between the opposing package panels or sheets and further extend around a substantial portion of the perimeter of the package contents.

In some circumstances, the hermetic seal is peelable such that it is sufficiently strong to keep the package intact and the contents thereof in place, but is desirably weak to permit the user to easily gain access to the contents without the need for scissors or the like. These peelable seals can be formed by either heat sealing or adhesive sealing the package panels together. While some common packaging materials such as polyethylene, polybutene and polypropylene films are easily heat sealable, other packaging materials, such as polyvinyl chloride, polyamide, polyester and polyacrylonitrile films are not heat sealable. In order to obtain a peelable seal on these packaging films, either the composition of the film must be changed to include a heat sealable material or an adhesive must be used. Where a heat sealable component is added to the packaging film mixture, the cost and complexity of the resulting package may be increased. When adhesive sealing is used to establish a peelable, hermetic seal, a hot melt adhesive is typically applied to one of the two opposing package film sheets. The opposing package film sheet is subsequently attached to the first package film sheet. However, in this application, the adhesive does not separate completely or uniformly from either package film panel, but adheres to different portions of both opposing panels. When this occurs, the adhesive exhibits "stringing", that is, where segments of the adhesive remain adhered to both package panels and span the gap between them when the package is initially opened. This occurrence is known as "stringing". Further opening of the package results in the strands of adhesive rupturing and remnants of the adhesive remaining on both package panels. This "stringing" is undesirable from a visual perspective and sometimes leads to an inconsistent amount of digital force required to open the seal and pull the package panels apart.

The present invention therefore concerns itself with the establishment of peelable, adhesive-based hermetic seals between two sheets of packaging material which are not heat sealable in nature, such as polyester, polyvinyl chloride polyamide and polyacrylonitrile films. Specifically, it is directed to producing a peelable seal on polyacrylonitrile films, such as Barex, (an acrylonitrile methyl acrylate copolymer) which has been surface treated to substantially reduce the strength of the bond between the treated film and the adhesive such that the adhesive completely and uniformly separates from the treated film and remains on the untreated film and no "stringing" results.

Such a seal is accomplished by providing a sheet of polyacrylonitrile film, such as Barex, and surface treating either a portion or all of that film sheet with a corona discharge to increase the surface tension of the film. A hot melt adhesive may be applied to the treated film and a package is subsequently formed by combining the treated film and a similar, but untreated, Barex packaging film. The corona discharge treatment increases the surface tension of the film, yet unexpectedly decreases the strength of the adhesive bond such that when the package is opened the adhesive is completely and uniformly pulled away from the treated surface visually without any undesirable "stringing" resulting.

Accordingly, it is an object of the present invention to provide a food product package having an adhesive-based hermetic peelable seal in which the peelable seal area opens uniformly without the adhesive exhibiting "stringing".

It is another object of the present invention to provide a method for manufacturing a package from two opposing packaging film sheets and having a peelable seal which permits access to the contents of the package in which one of the package film sheet is treated by a corona discharge treatment prior to adhesion to the other opposing film sheet, the treated film sheet being subsequently adhered by an adhesive to the other film sheet such that the bond strength of the peelable seal at the sealed interface of the two film sheets requires a decreased opening force so that the adhesive easily and uniformly releases from the treated film when the package is opened.

It is a further object of the present invention to provide a food product package formed from a single sheet of polyacrylonitrile film which is separated into two opposing package portions by an integral hinge portion, one of the opposing package portions being subjected to a corona discharge treatment, a hot melt adhesive being applied to the treated package portion and the two opposing package portions being folded upon each other around the hinge member and adhered to each other, the adhesive forming, a peelable seal area having a decreased adhesive strength and which adhesive uniformly separates away from the treated package portion.

It is yet a further object of the present invention to provide a food product package composed of two opposing package films sealed together at least one peel seal area, one of the packaging films being treated by a corona discharge treatment prior to adhesions together, wherein the opening force required to separate opposing package panels at the seal interface thereof is substantially reduced compared to a similar peel seal formed between two untreated packaging films.

These and other objects of the present invention will become more readily apparent from a reading of the following detailed description taken in conjunction with the accompany drawings wherein like reference numerals refer to like parts.

BRIEF DESCRIPTION OF THE DRAWINGS

In the course of this description, reference will be made to the attached drawings in which.

DETAILED DESCRIPTION OF THE DRAWINGS

Figure 1:
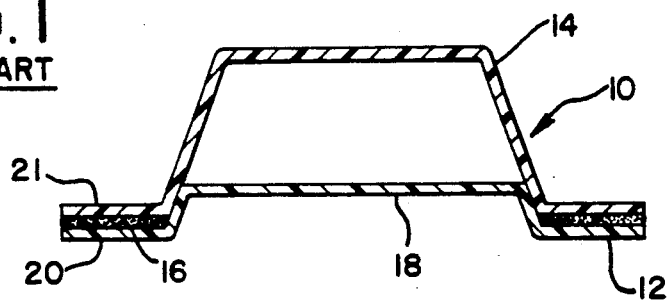
FIG. 1 PRIOR ART
FIG. 1 illustrates a sectional view of a food product package typical of the prior art.

FIG. 1 shows a package which is representational of packages presently used in the food product package art. The package 10 has a base package film 12 and a formed cover or bubble film 14 disposed in an overlying relationship and adhered together by an adhesive deposit 16. In the assembly of such packages 10, a hot melt adhesive 16 is applied to either an exterior circumferential flange 20 of the base film 12 or an exterior flange 21 of the cover 14. The product is loaded into the base film pedestal portion 18 and the cover film 14 is pressed against the base film 12 and, if desired, heated to reactivate the adhesive.

Figure 2:
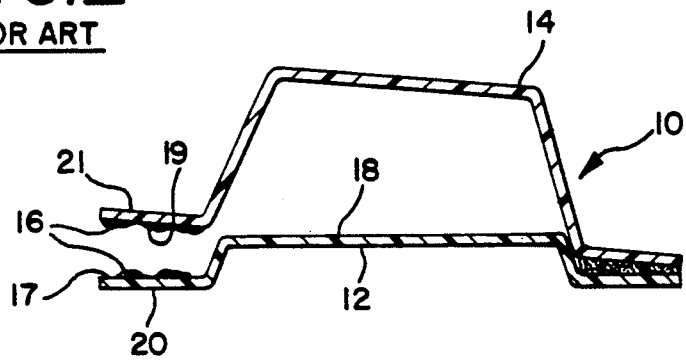
FIG. 2 PRIOR ART
FIG. 2 is a sectional view of the package of FIG. 1 during the opening sequence.

Such packages 10 are opened by the user gripping the exterior flanges 20, 21 of the opposing base and cover films 14, 16 and pulling them apart. As shown in FIG. 2, when the base film 12 is peeled away from the covering film 14, the adhesive 16 tends to be retained on both of the seal surfaces 17, 19 of the opposing covering and base film sheets and does not rupture in a uniform manner. Rather, the adhesive 16 adheres to both opposing films and stretches in the gap between the film sheets. As the user force increases, the adhesive 16 ruptures and separates apart in various locations between the opposing package films and remnants of the adhesive remain on both film seal surfaces 17 and 19, creating a visually undesirable condition known as "stringing". This "stringing" is found on packages regardless of whether the opposing package members are formed from polyethylene, polypropylene, polyester, polyvinyl chloride, polyamide, polyethermide or polyacrylonitrile films.

Figure 3:
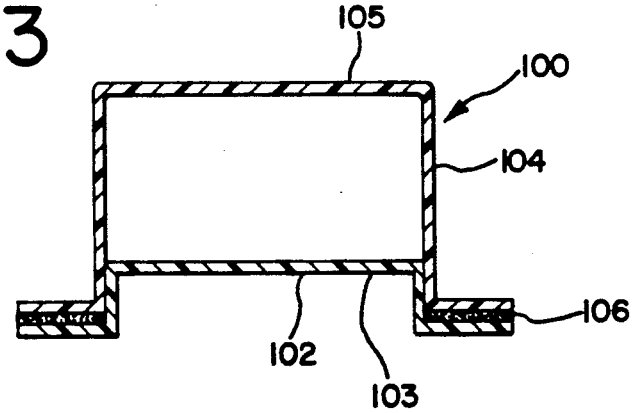
FIG. 3 is a sectional view of a food product package incorporating principles of the present invention in an assembled, unopened state.
Figure 4:
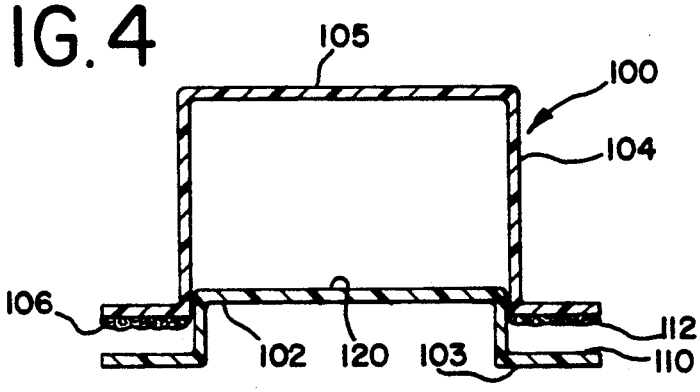
FIG. 4 is a sectional view of the package of FIG. 3 after opening.

Such "stringing" does not occur in packages constructed in accordance with the present invention wherein one of the packaging members is formed from a polyacrylonitrile film which is subjected to a corona discharge treatment. FIGS. 3 and 4 illustrate a package 100 incorporating the principles of the present invention in which two opposing packaging films 102, 104 are formed into their respective base and cover member shapes, such as the pedestal member 103 and the bubble member 105 illustrated. Both of the opposing packaging films are a polyacrylonitrile film and, preferably are Barex films. Barex is typically available as an acrylonitrile methyl acrylate copolymer or a mixture of acrylonitrile methyl acrylate copolymer and an elastomeric acrylonitrilebutadiene copolymer. Barex packaging films similar to other polyacrylonitrile films possess the normal physical properties desired for a packaging film, such as transparency, impact strength, flexibility, tear strength, suitability for printing with inks and like. However, similar to polyacrylonitrile films and other films such as polyester, polyvinylchloride and polyamide films, Barex packaging films cannot be heat sealed together to obtain a peelable seal. To obtain a peelable seal, an adhesive, such as a hot melt adhesive must be applied to one package film to secure the package together.

Prior to forming and assembly of the package 100, one sheet 102 of the Barex packaging film is subjected to a corona discharge treatment having an intensity of between approximately 2 watt/ft.$^2$ minute and approximately 8 watts/ft.$^2$ minute. This corona discharge treatment, as is known in the art, increases by 50% or more, the surface tension of the Barex film from its typical untreated surface tension of about 39 dynes per centimeter to upwards of 60 dynes per centimeter. As taught by the prior art, this increase in surface tension is expected to result in improved adhesion of applied materials such as printing inks and adhesives. However, when a Barex film is so treated, it surprisingly and unexpectedly results in reduced bond strength between the treated Barex film and an adhesive applied thereto. Moreover, we have found that this unexpected result leads to a substantial reduction in the opening force at the seal interface such that the adhesive 106 uniformly and clearly peels away from the untreated Barex film without the adhesion rupturing irregularly and exhibiting "stringing".

After treatment of the film 102 with the corona discharge treatment, a hot melt adhesive 106 is applied to either one of the two respective sealing surfaces 110, 112 of the packaging films 102, 104. Product is then loaded onto the pedestal portion 120 and the bubble covering member 105 is pressed over and against the base member 103. When opened, as shown in FIG. 4, the adhesive 106 peels cleanly and uniformly away from the treated film 102 (in this instance, the base member 103) and remains in place on the untreated cover member 105. It will be understood that not only the treatment of the packaging film can be applied to either of the package base 102 or cover members 104, but also the application of adhesive 106.

Other packaging advantages are further obtained by this process. One advantage is that the surface of the treated packaging film is the surface at which the failure occurs. This allows the manufacturer to control the exact placement of the failure surface and thereby determine exactly where adhesive will remain after opening. As previously mentioned, "stringing" of the adhesive between the two opposing packaging films at the seal interface is also eliminated.

The following example highlights some of the advantages of the present invention.

EXAMPLE 1

A two-piece ham package having a base member formed from a Barex packaging film and a covering member formed from a Barex film in the shape of a bubble member were provided. A conventional hot melt adhesive, such as Findley Adhesive 495-338-01, was applied to an outer sealing flange of the base member. Neither the base member nor the cover member was subjected to a corona discharge treatment. When opened, the package seal interface displayed a substantial amount of "stringing". Adhesive remnants remained in place on both the covering member and the base member. The average whole packaging opening force was approximately 2.4 pounds.

In contrast, a similar two-piece ham package having a base member and a cover bubble member were formed from a Barex film. The covering member was treated with a corona discharge. The same Findley Adhesive 495-338-01 was applied to the outer flange of the untreated base member. When the package was opened no stringing of the adhesive occurred and the adhesive remained on the untreated package film. No adhesive was adhered to the covering member. The average whole package opening force for this package was approximately 1.3 pounds which is equivalent to a reduction of about 50% of the opening force required for the non-treated film package. Varying power levels ranging from 2 watts/ft.$^2$ per minute up to 8 watts/ft.$^2$ per minute were utilized and all such levels of corona discharge resulted in equivalent results.

Accordingly, the use of corona discharge pretreatment with respect to a polyacrylonitrile packaging films and, in particular, a Barex packaging film, substantially decreases the bond strength of the adhesive at the seal interface. This reduction in adhesive strength eliminates "stringing" and improves the visual appearance of the package after opening as well as allows the uniformity of the adhesive failure to be controlled.

Figure 5:
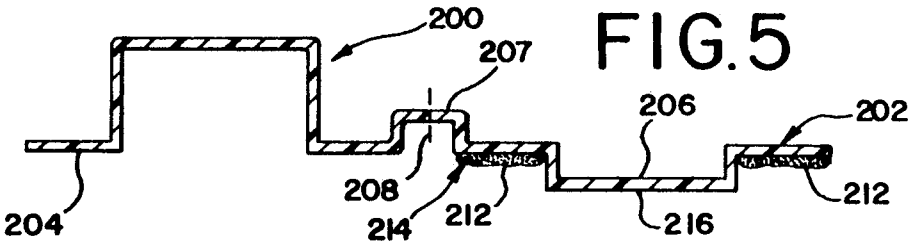
FIG. 5 is a plan view depicting an alternative embodiment of a package incorporating the principles of the present invention.
Figure 6:
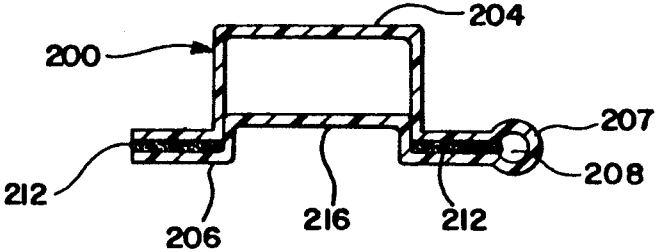
FIG. 6 is a sectional view of the package of FIG. 5 in an assembled state.

FIGS. 5 and 6 illustrate an alternate embodiment 200 of the present invention in which a package 200 is formed from a single sheet of Barex packaging film 202. The packaging film 202 is divided into two generally equal package portions 204, 206 by an integral or "living" hinge 207 which extends along its centerline 208. One package portion 204 is subjected to a corona discharge treatment prior to assembly. A hot melt adhesive 212 is applied to the designated sealing surface 214 and a food product is placed on a product support portion 216 either immediately after application of the adhesive 212 or long after the adhesive has cooled. The two opposing package portions are then folded upon each other along the center hinge 207 and the two opposing package film surfaces are adhered together. When opened, the adhesive will not "string", but will clearly remove itself from the treated film 204.

Figure 8:
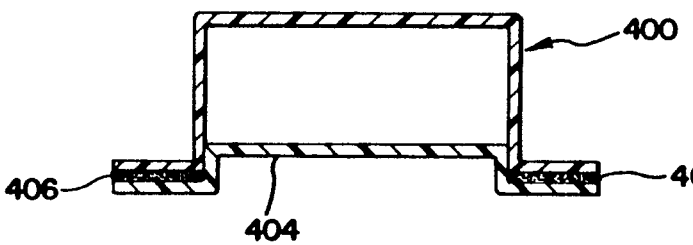

In another application of the present invention, and as shown in FIG. 8, a package 400 is provided with a polyacrylonitrile film 402 such as Barex and an opposing packaging film of polyethylene or polypropylene 404. In this instance, both films are subjected to a corona discharge pretreatment before application of the adhesive 406 and assembly of the two opposing package member 402 and 404. Consistent with the results obtained above, the adhesive 406 will peel cleanly away from the treated Barex film 402 and remain in place on the opposing treated polyethylene or polypropylene film 404. In this regard it is to be noted that corona discharge treatment of polyethylene and polypropylene films increases the surface tension of these films and increases the adhesion characteristics thereof. Nevertheless, the combination of the increased adhesion on the one film and the decreased adhesion on the opposing film produces unexpected non-"stringing" and easy release of the adhesive from the treated Barex film 402.

Figure 7:
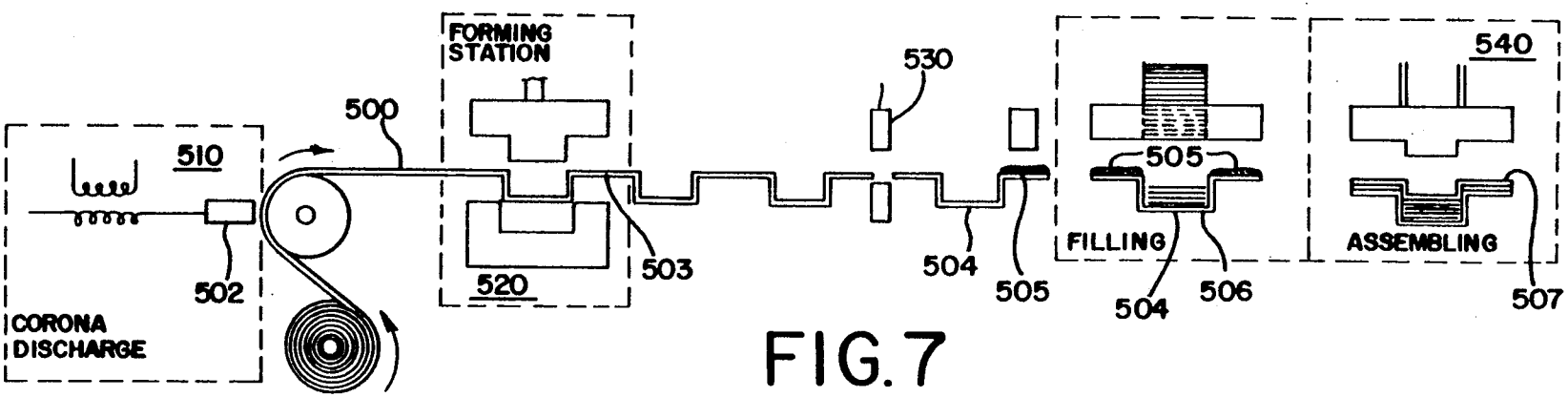
FIG. 7 is a diagram illustrating the production steps necessary for assembly of the packages of the present invention; and, FIG. 8 is a sectional view of another alternate embodiment of a package incorporating.

Lastly, FIG. 7 is representational of a process used to produce the present invention. A packaging film 500 is supplied from supply rollers 501 to a discharge treatment location 510, where an electrode 502 subjects the film 500 to a desired intensity level to produce the results desired. The film 500 is then passed into a forming station 520 where it is formed into a series of package components 503, which is subsequently separated into a single package component 504 at a severing location 530. A suitable adhesive 505 is applied to the single package components 504 and the package is then filled with product 506. Downstream, an opposing package component 507, which has been previously formed, is applied at an assembly location 540 to produce a finished package.

It will be seen that while certain embodiments of the present invention have been shown and described it will be obvious to those skilled in the art that changes and modifications may be made therein without departing from the true spirit of the scope of the invention.

We claim:

1. A method of making an adhesive-based hermetic, peelable seal for a food product package, in which the peelable seal uniformly ruptures when the package is opened, without the adhesive stringing comprising the steps of:

providing first and second package panels, at least one of said package panels being a polyacrylonitrile film;

subjecting a surface of one of said first and second package panels which is a polyacrylonitrile film to a corona discharge to increase the surface tension thereof and reduce the adhesion characteristics thereof between said one polyacrylonitrile film panel and a peelable adhesive subsequently applied thereto;

applying said peelable adhesive to one of said first and second package panels in a predesignated peelable seal area; and adhering said first and second package panels to each other, such that when said package is opened by separating the panels, said adhesive peels away from the package panel that had undergone said subjecting step without stringing of the adhesive applied during said applying step, and substantially all of said adhesive remains substantially adhered to the panel that had not undergone said subjecting step.

2. The method of claim 1, wherein said first and second package panels include a polyacrylonitrile film.

3. The method of claim 1, wherein said polyacrylonitrile film is a film formed from an acrylonitrile methyl acrylate copolymer.

4. The method of claim 1, wherein said second package panel is formed from a packaging film chosen from the group consisting of polyethylene, polypropylene, polyester, polyvinylchloride and polyamide films.

5. The method of claim 1, further including the step of placing a product onto a product contact surface of one of said first and second package panels prior to adhering said first and second package panels together.

6. The method of claim 1, wherein said first and second package panels are integrally joined together by a hinge member.

7. The method of claim 1, wherein said corona discharge treatment has an intensity of between 2 watts/ft.$^2$ per minute and 8 watts/ft.$^2$ per minute.

8. The method of claim 1, wherein the surface tension of said first panel is increased to between approximately 50 and approximately 60 dynes/centimeter after treatment by corona discharge.

9. The method of claim 1, wherein the surface tension of said first panel is increased approximately 50% after treatment by corona discharge.

10. A method of manufacturing a package for a food product from two opposing packaging films, the package having an adhesive-based peelable seal, the method comprising the steps of:

providing two polyacrylonitrile package films;

subjecting only one of the two package films to a corona discharge treatment to increase the surface tension of at least one surface thereof to between approximately 50 dynes per centimeter and approximately 60 dynes per centimeter;

applying an adhesive to one of said two packaging films along a predesignated seal area thereon;

placing a product on one of said two packaging films within an area bounded by said predesignated seal area;

contacting said two package films together at said predesignated seal area to form a hermetic, peelable seal, such that when said package is opened, said adhesive peels away, without stringing, from said package film subjected to the corona discharge treatment, and said adhesive further remains substantially adhered to an opposing package film which had not been subjected to the corona discharge treatment, 11. The method claim 10, wherein said two package films are formed films.

12. The method of claim 10, wherein one of said two package films has a product cavity formed therein.

13. The method of claim 12, wherein the opposing package film of said two packaging films has a product pedestal portion formed therein.

14. The method of claim 10, wherein said two package films are integrally joined by a living hinge member.

15. The method of claim 10, wherein the intensity of said corona discharge is between approximately 2 watts/ft$^2$ per minute and approximately 8 watts/ft$^2$ per minute.

16. The method of claim 10, wherein said corona discharge treatment is carried out at ambient temperature.

17. A food product package made in accordance with the method of claim 10.

18. A hermetically peelable sealed structure enclosing a product, the structure being formed from a first packaging film and a second packaging film, each packaging film having a sealing surface, the first packaging film being a polyacrylonitrile film, the sealing surface of said first packaging film having been subjected to a corona discharge to increase the surface tension thereof, an adhesive layer disposed between the respective sealing interfaces of said first and second packaging films, the bond strength of said adhesive layer between said first and second packaging films being substantially reduced by virtue of said corona discharge treatment of aid first packaging film, such that, when said sealed structure is opened, said adhesive layer uniformly peels away from said first packaging film treated surface, without stringing, while remaining substantially adhered to said second packaging film sealing surface.

19. The structure of claim 18, wherein said second package film is a polyacrylonitile film which had not been subjected to a corona discharge.

20. The structure of claim 18, wherein said first and second package films are formed from an acrylonitrile methyl acrylate copolymer, the second of which had not been subjected to a corona discharge.

21. The structure of claim 18, wherein said first package film sealing surface is subjected to a corona discharge treatment of approximately between 2 watts/ft$^2$ per minute and approximately 8 watts/ft$^2$ per minute.

22. The structure of claim 18, wherein said corona discharge treatment increases the surface tension of said first package film to between approximately 50 dynes per centimeter and approximately 60 dynes per centimeter.

23. The structure of claim 18, wherein said corona discharge treatment increases the surface tension of said first package film by approximately 50%.

24. The structure of claim 18, wherein said second package film is chosen from the group consisting of polyethylene, polypropylene, polyvinyl chloride, polyamide films and mixtures thereof.

25. A package enclosing a food product between opposing first and second package panels, the first package panel including a polyacrylonitrile film which has been treated with a corona discharge treatment at an intensity level of between approximately 2 watts per square foot per minute and approximately 8 watts per square foot per minute to thereby increase the surface tension of a sealing surface of said first package panel to between approximately 50 and 60 dynes per centimeter, hot melt adhesive means disposed between and in adhesive contact with said first package panel sealing surface and an opposing sealing surface of said second package panel, such that the corona discharge treatment reduces bond strength between said adhesive means and said first package panel sealing surface such that said adhesive means ruptures uniformly, without stringing, and when said package is opened said adhesive means remains on said second package panel sealing surface.

26. The package of claim 25 wherein said second package panel is a film chosen from the group consisting of polyethylene, polypropylene, polyvinyl chloride, polyamide and mixtures thereof, said second package panel sealing surface also having been treated with a corona discharge treatment to increase the surface tension thereof.

* * * * *